US008107631B2

(12) United States Patent
Merimaa et al.

(10) Patent No.: US 8,107,631 B2
(45) Date of Patent: Jan. 31, 2012

(54) CORRELATION-BASED METHOD FOR AMBIENCE EXTRACTION FROM TWO-CHANNEL AUDIO SIGNALS

(75) Inventors: Juha Oskari Merimaa, Menlo Park, CA (US); Michael M. Goodwin, Scotts Valley, CA (US); Jean-Marc Jot, Aptos, CA (US)

(73) Assignee: Creative Technology Ltd, Singapore (SG)

( * ) Notice: Subject to any disclaimer, the term of this patent is extended or adjusted under 35 U.S.C. 154(b) by 832 days.

(21) Appl. No.: 12/196,239

(22) Filed: Aug. 21, 2008

(65) Prior Publication Data

US 2009/0092258 A1 Apr. 9, 2009

Related U.S. Application Data

(60) Provisional application No. 60/977,600, filed on Oct. 4, 2007.

(51) Int. Cl.
*H04R 5/00* (2006.01)

(52) U.S. Cl. ..... 381/1; 381/17
(58) Field of Classification Search ..... 381/1–17
See application file for complete search history.

(56) References Cited

U.S. PATENT DOCUMENTS

| | | | | |
|---|---|---|---|---|
| 7,995,676 | B2 * | 8/2011 | Fite et al. | 375/316 |
| 2009/0198356 | A1 * | 8/2009 | Goodwin et al. | 700/94 |
| 2009/0252356 | A1 * | 10/2009 | Goodwin et al. | 381/310 |
| 2011/0200196 | A1 * | 8/2011 | Disch et al. | 381/22 |

* cited by examiner

*Primary Examiner* — Cuong Q Nguyen

(57) ABSTRACT

A method of ambience extraction includes analyzing an input signal to determine the time-dependent and frequency-dependent amount of ambience in the input signal, wherein the amount of ambience is determined based on a signal model and correlation quantities computed from the input signals and wherein the ambience is extracted using a multiplicative time-frequency mask. Another method of ambience extraction includes compensating a bias in the estimation of a short-term cross-correlation coefficient. In addition, systems having various modules for implementing the above methods are disclosed.

20 Claims, 6 Drawing Sheets

CORRELATION-BASED METHOD FOR AMBIENCE EXTRACTION FROM TWO-CHANNEL AUDIO SIGNALS

RELATED APPLICATIONS

This application claims the benefit of U.S. Provisional Application No. 60/977,600, filed on Oct. 4, 2007, the entire specification of which is incorporated herein by reference in its entirety.

BACKGROUND OF THE INVENTION

1. Field of the Invention

The present invention relates to audio processing techniques. More particularly, the present invention relates to systems and methods for extracting ambience from audio signals.

2. Description of the Related Art

Various techniques are available for extracting ambience components from a two-channel stereo signal. The stereo signal may be decomposed into a primary component and an ambience component. One common application of these methods is listening enhancement systems where ambient signal components are modified and/or spatially redistributed over multichannel loudspeakers, while primary signal components are unmodified or processed differently. In these systems, the ambience components are typically directed to surround speakers. This ambience redistribution helps to increase the sense of immersion in the listening experience without compromising the stereo sound stage.

Some prior frequency-domain ambience extraction methods derive multiplicative masks describing the amount of ambience in the input signals as a function of time and frequency. These solutions use ad hoc functions for determining these ambience extraction masks from the correlation quantities of the input signals, resulting in suboptimal extraction performance. One particular source of error occurs when the dominant (non-ambient) sources are panned to either channel; prior methods admit significant leakage of the dominant sources in such cases. Another source of error in prior methods arises from the short-term estimation of the magnitude of the cross-correlation coefficient. Short-term estimation is necessary for the operation of mask-based approaches, but prior approaches for short-term estimation lead to underestimation of the amount of ambience.

What is desired is an improved method for ambience extraction.

SUMMARY OF THE INVENTION

The present invention provides systems and methods for extracting ambience components from a multichannel input signal using ambience extraction masks. Solutions for the ambience extraction masks are based on signal correlation quantities computed from the input signals and depend on various assumptions about the ambience components in the signal model. The present invention in various embodiments implements ambience extraction in a time-frequency analysis-synthesis framework. Ambience is extracted based on derived multiplicative masks that reflect the current estimated composition of the input signals within each frequency band. In general, operations are performed independently in each frequency band of interest. The results are expressed in terms of the cross-correlation and autocorrelations of the input signals. The analysis-synthesis is carried out using a time-frequency representation since such representations facilitate resolution of primary and ambient components. At each time and frequency, the ambience component of each input channel is estimated.

According to one aspect of the invention, a method of ambience extraction from a multichannel input signal includes converting the input signal into a time-frequency representation. Autocorrelations and cross-correlations for the time-frequency representations of the input channel signals are determined. An ambience extraction mask based on the determined autocorrelations and cross-correlations is multiplicatively applied to the time-frequency representations of the input channel signals to derive the ambience components. The mask is based on an assumed relationship as to the ambience levels in the respective channels of the input signal.

According to another aspect of the invention, a method of ambience extraction includes analyzing an input signal to determine the amount of ambience in the input signal. Analyzing the input signal comprises estimating a short-term cross-correlation coefficient. The method also includes compensating for a bias in the estimation of the short-term cross-correlation coefficient.

According to yet another aspect of the invention, a system for extracting ambience components from a multichannel input signal is provided. The system includes a time-to-frequency transform module, a correlation computation module, an ambience mask derivation module, an ambience mask multiplication module, and a frequency-to-time transform module. The time-to-frequency transform module is configured to convert the multichannel input signal into time-frequency representations for the respective channels of the multichannel input signal. The correlation computation module is configured to determine signal correlations including the cross-correlation and autocorrelations for each time and frequency in the time-frequency representations. The ambience mask derivation module is configured to derive the ambience extraction mask from the determined signal correlations and an assumed relationship as to the ambience levels in the respective channels of the multichannel input signal. The ambience mask multiplication module is configured to multiply the ambience extraction mask with the time-frequency representations to generate a time-frequency representation of the ambience component for respective channels of the multichannel input signal. The frequency-to-time transform module is configured to convert the time-frequency representations of the ambience components into respective time representations.

These and other features and advantages of the present invention are described below with reference to the drawings.

DETAILED DESCRIPTION OF PREFERRED EMBODIMENTS

Figure 1A:
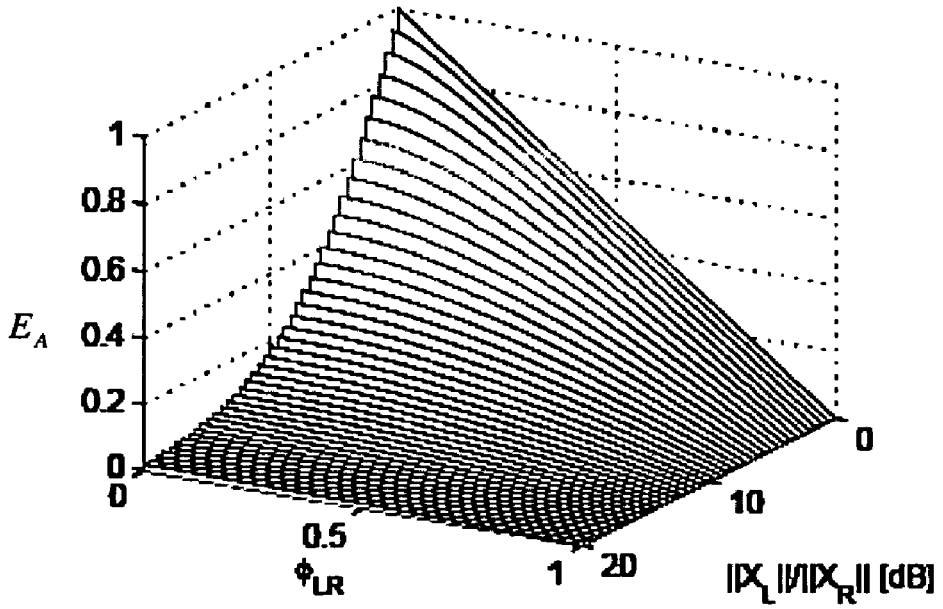
FIGS. 1A and 1B illustrate the ambience ratio and the behavior of the ambience masks as a function of the correlation coefficient $\phi_{LR}$ and the level difference between the input signals.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

1. INTRODUCTION

Embodiments of the invention provide improved systems and methods for ambience extraction for use in spatial audio enhancement algorithms such as 2-to-N surround upmix, improved headphone reproduction, and immersive virtualization over loudspeakers. The invention embodiments include an analytical solution for the time- and frequency-dependent amount of ambience in each input signal based on a signal model and correlation quantities computed from the input signals. The algorithm operates in the frequency domain. The analytical solution provides a significant quality improvement over the prior art. The invention embodiments also include methods for compensating for underestimation of the amount of ambience due to bias in the magnitude of short-term cross-correlation estimates.

To further elaborate, the invention embodiments provide analytical solutions for the ambience extraction masks given the autocorrelations and cross-correlations of the input signals. These solutions are based on a signal model and certain assumptions about the relative ambience levels within the input channels. Two different assumptions about the relative levels are described. According to some embodiments, techniques are provided to compensate for the effect of small time constants on the mean magnitude of the short-term cross-correlation estimates. The time-constant compensation is expected to be useful for any technology using short-term cross-correlation computation, including commercially available ambience extraction methods as well as current spatial audio coding standards.

In state-of-the-art stereo upmixing, it is common to distinguish between primary (direct) sound and ambience. The primary sound consists of localizable sound events and the usual goal of the upmixing is to preserve the relative locations and enhance the spatial image stability of the primary sources. The ambience, on the other hand, consists of reverberation or other spatially distributed sound sources. A stereo loudspeaker system is limited in its capability to render a surrounding ambience, but this limitation can be overcome by extracting the ambience and (partly) distributing it to the surround channels of a multichannel loudspeaker system.

When extracting the ambience, a single-channel approach may be used where the left ambience channel is extracted from the left input signal and the right ambience channel from the right input channel using scalar ambience extraction masks that are based on the auto- and cross-correlations of the input signals. However, in order for the magnitudes of the estimated ambience signals within the chosen time and frequency resolution to correspond to those of the true ambience signals, the extraction masks should correspond to the proportion of ambience in the respective channels. In order to solve for the time- and frequency-dependent levels of the ambient components, it is helpful to make certain assumptions about the input signals, specifically with respect to the ambience levels in the input signals.

In different embodiments of the invention, different assumptions are made with respect to the ambience levels. In a first embodiment, equal ratios are assumed within the respective channels (e.g., left and right channels) of the input signal. In a second embodiment, equal levels of ambience in the respective channels (e.g., left and right channels) of the input signal are assumed. In general, channels of a two-channel input signal are referred to as "left" and "right" channels. These methods provide a further improvement in extracting ambience from input content wherein the dominant (non-ambient) sources are panned to any particular channel.

In addition, the short-time estimation of the cross-correlation coefficient is improved with a compensation factor applied to the magnitude of the estimated cross-correlation coefficient in accordance to various embodiments of the invention. As such, a more effective ambience extraction mask can be derived and applied to the input signal for extracting ambience.

2. GENERAL CONSIDERATIONS

2.1. Ambience Extraction Framework

The ambience extraction techniques described herein are implemented in a time-frequency analysis-synthesis framework. For an arbitrary mixture of multiple non-stationary primary sources, this approach enables robust independent processing of simultaneous sources (provided that they do not overlap substantially in frequency), and robust extraction of ambience components from the mixture. A time-frequency processing framework can also be motivated based on psychoacoustical evidence of how spatial cues are processed by the human auditory system (See J. Blauert, *Spatial Hearing: The Psychophysics of Human Sound Localization*. Cambridge, Mass., USA: The MIT Press, revised ed., 1997, the content of which is incorporated herein by reference in its entirety).

For the methods described in Section 3 below, the ambience extraction process is based on deriving multiplicative masks that reflect the current estimated composition of the input signals within each frequency band. The masks are then applied to the input signals in the frequency domain, thus in effect realizing time-variant filtering.

2.2. Notation and Definitions

In general, expressions in this detailed description are derived for analytical (complex) time-domain signals of arbitrary limited duration determined by the chosen time resolution. The complex formulation enables applying the equations directly to individual transform indices (frequency bands) resulting from short-time Fourier transform (STFT) of the input signals. Moreover, the equations hold without modifications for real signals, and could readily be applied to other time-frequency signal representations, such as subband signals derived by an arbitrary filter bank. Furthermore, operations are assumed to be performed independently in each frequency band of interest. The (subband) time domain signals are generally represented as column vectors and denoted with an arrow symbol over the signal designation (e.g., $\vec{X}$). However, in order to improve the clarity of the presentation, the time- and/or frequency-dependence are in some cases explicitly notated and the vector sign is omitted. With respect to the signal model, the true components comprising the signal are denoted with normal symbols (e.g. $\vec{A}$) and the estimates of these components with corresponding italic symbols (e.g. $\vec{A}$).

Many of the results derived in this detailed description are expressed in terms of correlations of the two input signals. The autocorrelations and cross-correlation of signals $\vec{X}_L=[x_L[1]x_L[2]\ldots x_L[N]]^T$ and $\vec{X}_R=[x_R[1]x_R[2]\ldots x_L[N]]^T$ are defined for the purpose of this specification as $$r_{LL}=\vec{X}_L^H\vec{X}_L=\sum_{i=1}^{N}x_L^*[n]x_L[n]=\|\vec{X}_L\|^2 \tag{1}$$

$$r_{RR}=\vec{X}_R^H\vec{X}_R=\sum_{i=1}^{N}x_R^*[n]x_R[n]=\|\vec{X}_R\|^2 \tag{2}$$

$$r_{LR}=\vec{X}_L^H\vec{X}_R=\sum_{i=1}^{N}x_L^*[n]x_R[n]=r_{RL}^* \tag{3}$$

and the cross-correlation coefficient is defined as $$\phi_{LR}=\frac{r_{LR}}{\sqrt{r_{LL}r_{RR}}}=\frac{\vec{X}_L^H\vec{X}_R}{\|\vec{X}_L\|\|\vec{X}_R\|} \tag{4}$$

where T denotes transposition, H denotes Hermitian transposition, * denotes complex conjugation, and $\|\bullet\|$ denotes the magnitude of a vector. Note that the magnitude of a signal vector is equivalent to the square root of the corresponding autocorrelation.

2.3. Signal Model

For the purposes of this detailed description, any input signals at a single frequency band and within a time period of interest $\{\vec{X}_L, \vec{X}_R\}$ are assumed to be composed of a single primary component and ambience:

$$\vec{X}_L=\vec{P}_L+\vec{A}_L$$

$$\vec{X}_R=\vec{P}_R+\vec{A}_R \tag{5}$$

where $\vec{P}_L$ and $\vec{P}_R$ are the primary components and $\vec{A}_L$ and $\vec{A}_R$ are the ambient components. This assumption is not entirely valid in that multiple primary sounds may be present, but it has proven to be a reasonable approximation within the time-frequency ambience extraction framework.

In order to estimate the primary and ambient signal components, some further assumptions can be made about their properties. In cases discussed later in this detailed description, it is assumed that the two ambience signals are uncorrelated both mutually and with the primary sound. Furthermore, it can be assumed that the cross-correlation coefficient of the primary signals has a magnitude of one, meaning that the primary signals are identical apart from possible level and phase differences. Allowing level and phase differences effectively allows amplitude and/or delay-panned as well as matrix-encoded components within the category of primary sound (for further discussion on ambience extraction in the context of matrix encoding/decoding, see J.-M. Jot, A. Krishnaswamy, J. Laroche, J. Merimaa, and M. M. Goodwin, "Spatial Audio Scene Coding in a universal two-channel 3-D stereo format," in *AES 123rd Convention*, (New York, N.Y., USA), October 2007, the content of which is incorporated herein by reference in its entirety). With the above assumptions, $$\|\vec{X}_L\|^2=\|\vec{P}_L\|^2+\|\vec{A}_L\|^2$$

$$\|\vec{X}_R\|^2=\|\vec{P}_R\|^2+\|\vec{A}_R\|^2 \tag{6}$$

$$r_{LR}=\vec{P}_L^H\vec{P}_R \tag{7}$$

$$|r_{LR}|=\|\vec{P}_L\|\|\vec{P}_R\| \tag{8}$$

where $|\bullet|$ denotes the magnitude of a complex number.

3. AMBIENCE EXTRACTION MASKS

Based on the signal model defined in Section 2.3, several ambience extraction methods suitable for the framework of Section 2.1 can be derived. This section concentrates on a single-channel approach, wherein the left ambience channel is extracted from the left input signal and the right ambience channel from the right input channel using scalar ambience extraction masks that are based on the auto- and cross-correlations of the input signals. The processing can be described formally as $$A_L(t,f)=\alpha_L(t,f)X_L(t,f)$$

$$A_R(t,f)=\alpha_R(t,f)X_R(t,f) \tag{9}$$

where $\alpha_L(t, f)$ and $\alpha_R(t, f)$ are the ambience extraction masks, t is time, and f is frequency.

For the purposes of this section, $\alpha_L(t, f)$ and $\alpha_R(t, f)$ are limited to real positive values. In order for the magnitudes of the estimated ambience signals within the chosen time and frequency resolution to correspond to those of the true ambience signals, the extraction masks should correspond to the proportion of ambience in the respective channels. That is, masks according to $$\alpha_L=\frac{\|\vec{A}_L\|}{\|\vec{X}_L\|}$$

$$\alpha_R=\frac{\|\vec{A}_R\|}{\|\vec{X}_R\|} \tag{10}$$

are sought where the true levels of the ambience signals need to be estimated.

Eqs. (6) and (8) give three relations between the auto- and cross-correlations of the known input signals and the levels of the four unknown signal components: the left and right primary sound and ambience. In order to effectively solve for the time- and frequency-dependent levels of the ambient components, additional assumptions about the input signals can be made. Two alternative assumptions are investigated in the following subsections 3.1 and 3.2.

3.1. Equal Ratios of Ambience

In some works (e.g., see C. Avendano and J.-M. Jot, "A frequency-domain approach to multichannel upmix," *J. Audio Eng. So.*, vol. 52, pp. 740-749, July/August 2004, the content of which is incorporated herein by reference in its entirety and herein referred to as "C. Avendano and J.-M. Jot, July/August 2004"), a common mask was used to extract the ambience from the left and right signals. The mask was formulated as a soft-decision alternative to a binary masking approach. In the binary case, at each time and frequency, a decision is made as to whether the signal consists of primary components or ambience; the ambience extraction mask is chosen to be 1 if the signal is deemed ambient, and 0 if it is deemed primary. Since such a hard decision approach leads to undesirable artifacts, a soft-decision function was introduced to determine the common mask from the correlation coefficient:

$$\alpha_{com}=\Gamma(1-|\phi_{LR}|) \tag{11}$$

where $\Gamma(\cdot)$ is a nonlinear function selected based on desired characteristics of the ambience extraction process; the argument $1|\phi_{LR}|$ displays the general desired trend of the soft-decision ambience mask; the desired trend is that the mask should be near zero when the correlation coefficient is near one (indicating a primary component) and near one when the correlation coefficient is near zero (indicating ambience), such that multiplication by the mask selects ambient components and suppresses primary components. The function $\Gamma(\cdot)$ provides the ability to tune the trend based on subjective assessment (See C. Avendano and J.-M. Jot, July/August 2004).

An alternative to subjectively tuning the decision function is to set $\alpha_L=\alpha_R$ and solve the system of Eqs. (6), (8), and (10) for the ideal common mask for correctly estimating the energy of the ambience components. This approach yields $$\alpha_{com}=\sqrt{1-|\phi_{LR}|} \tag{12}$$

Note that this suggests that the square root is a viable option for the $\Gamma(\cdot)$ function in Eq. (11).

The choice of $\alpha_L=\alpha_R$ implies the assumption that $$\frac{\|\vec{A}_L\|}{\|\vec{X}_L\|}=\frac{\|\vec{A}_R\|}{\|\vec{X}_R\|}=\alpha_{com} \tag{13}$$

This assumption has proven to be problematic in listening assessments if there is a considerable level difference between the channels. In the extreme case of having a signal in only one channel, the cross-correlation coefficient is not defined and $\alpha_{com}$ cannot be computed. Furthermore, any uncorrelated background noise in the "silent" channel leads in theory to $\alpha_{com}=1$ and the active channel will thus be estimated as fully ambient, which does not serve the purpose of the ambience extraction. In C. Avendano and J.-M. Jot, July/August 2004, these problems were solved by adopting an additional constraint such that the input signals were considered as fully primary if their level difference was above a set threshold. A similar approach could be incorporated in the current invention. Another way to enable correct treatment of input signals having a considerable level difference is to modify the assumption about the relative levels of the ambience signal components, as will be done in the following.

3.2. Equal Levels of Ambience

As discussed in C. Avendano and J.-M. Jot, July/August 2004, the ambience usually has equal levels in the left and right input channels in typical stereo recordings. A logical assumption for ambience extraction is therefore $$\|\vec{A}_L\|=\|\vec{A}_R\|=I_A \tag{14}$$

where the notation $I_A$ is introduced to denote the ambience level. With this assumption, the ambience masks can be derived as follows. From Eqs. (6), (8), and (14), the following equation can be derived:

$$|r_{LR}|^2=I_A^4-I_A^2(r_{LL}+r_{RR})+r_{LL}^2r_{RR}^2 \tag{15}$$

For the solution of $I_A^2$ from the above quadratic equation, it is required that $2I_A^2\leqq r_{LL}+r_{RR}$, namely that the total ambience energy is less than or equal to the total signal energy. This limits the number of solutions to one, yielding $$I_A^2=\frac{1}{2}\left(r_{LL}+r_{RR}-\sqrt{(r_{LL}-r_{RR})^2+4|r_{LR}|^2}\right) \tag{16}$$

The left and right extraction masks are thus simply $$\alpha_L=\frac{I_A}{\|\vec{X}_L\|}\qquad \alpha_R=\frac{I_A}{\|\vec{X}_R\|} \tag{17}$$

or, in terms of the autocorrelations, $$\alpha_L=\frac{I_A}{\sqrt{r_{LL}}}\qquad \alpha_R=\frac{I_A}{\sqrt{r_{RR}}} \tag{18}$$

Furthermore, the ratio of the total estimated ambience energy to the total signal energy can be expressed as $$E_A=\frac{\|\vec{A}_L\|^2+\|\vec{A}_R\|^2}{\|\vec{X}_L\|^2+\|\vec{X}_R\|^2}\qquad E_A=1-\frac{\sqrt{(r_{LL}-r_{RR})^2+4|r_{LR}|^2}}{r_{LL}+r_{RR}} \tag{19}$$

Figure 1B:
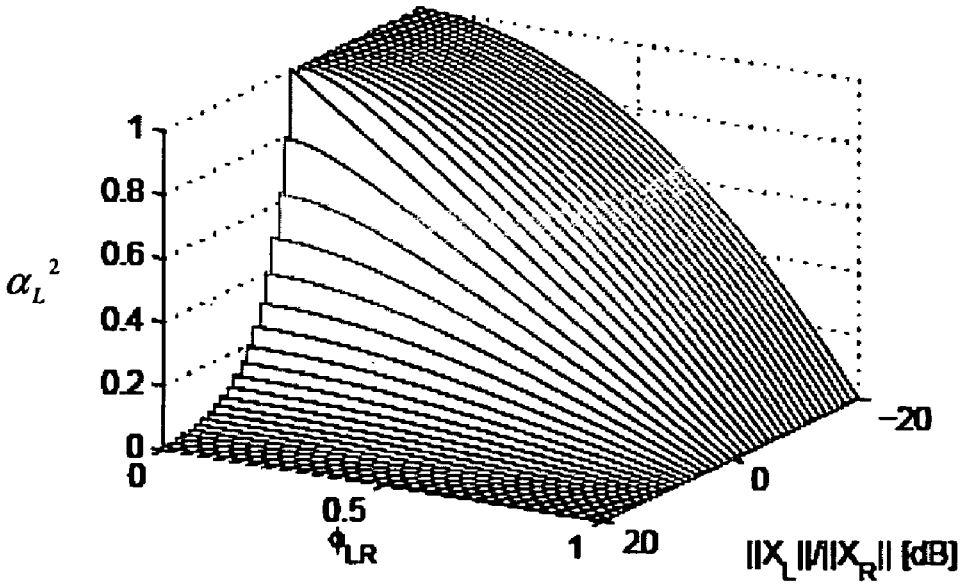

FIGS. 1A and 1B illustrate the ambience ratio and the behavior of the ambience masks as a function of the correlation coefficient $\phi_{LR}$ and the level difference between the input signals. Specifically, FIG. 1A illustrates $E_A$, the fraction of total ambience energy, as a function of the cross-correlation coefficient $\phi_{LR}$ and the level difference of the input signals whereas FIG. 1B illustrates $\alpha_L$, the fraction of ambience energy in $\vec{X}_L$, as a function of $\phi_{LR}$ and the level difference of the input signals.

For fully correlated input signals, the ambience ratio is 0 regardless of the levels of the input signals, in accordance with the signal model. For equal-level input signals ($r_{LL}=r_{RR}$ or equivalently $\|\vec{X}_L\|=\|\vec{X}_R\|$) the ambience ratio is a linear function of the cross-correlation coefficient and in this case the ambience masks in Eq. (18) are equal to the common mask formulated in Eq. (12). However, for signals with a correlation coefficient of 0, the ambience ratio is 1 only for the case of equal-level input signals; for an increasing level difference, the algorithm interprets the stronger signal as increasingly primary due to the assumption that the ambience in the input channels always has equal levels.

Figure 1C:
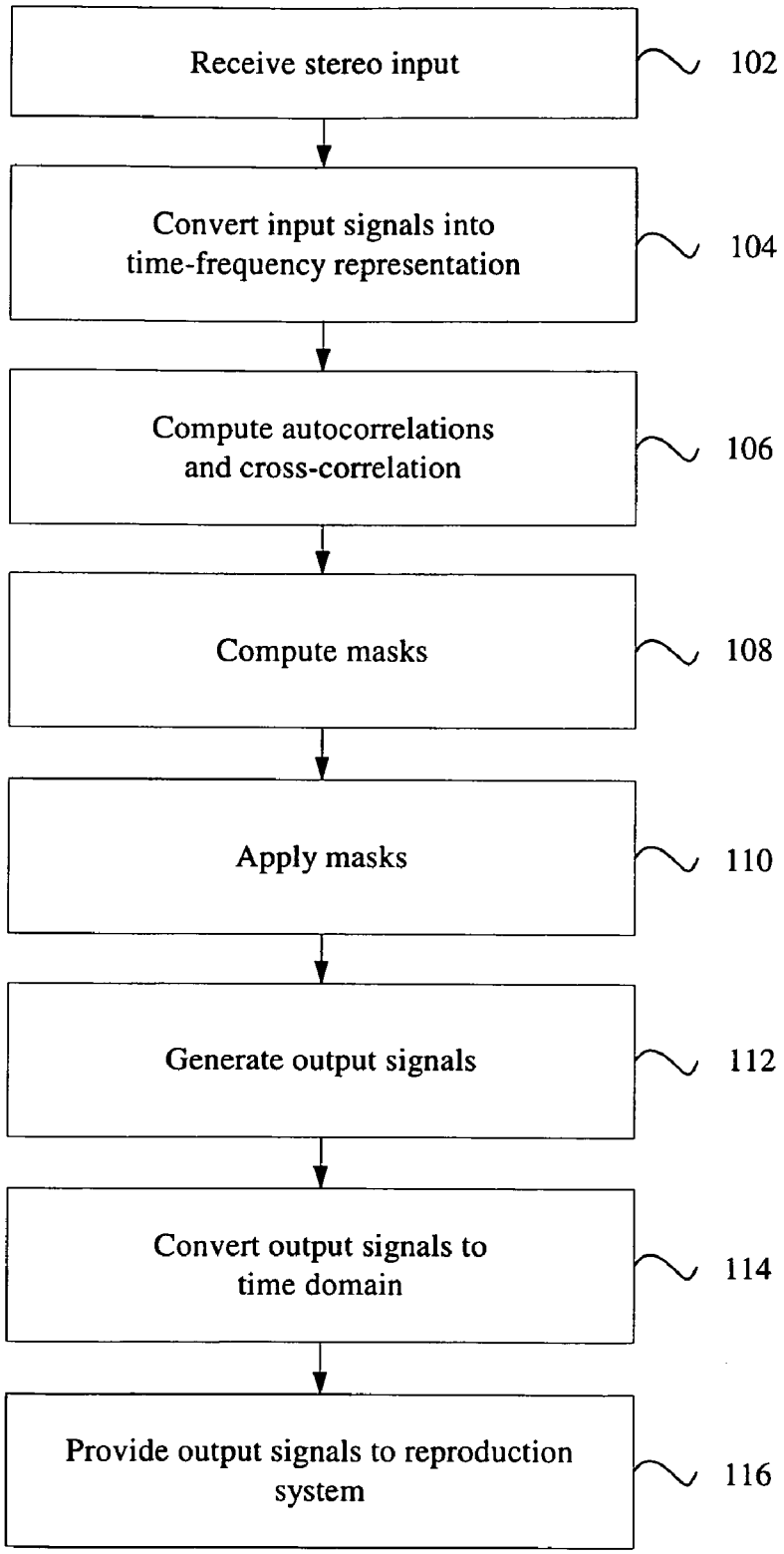
FIG. 1C is a flowchart illustrating a method of extracting ambience in accordance with one embodiment of the present invention.

In order to provide a general overview of the ambience extraction process, FIG. 1C depicts a flowchart illustrating a method of extracting ambience in accordance with one embodiment of the present invention. The method begins with the receipt of a stereo input signal in operation 102. Next, in operation 104, the input signals are converted to a frequency-domain or subband representation using any known method, for example a short-time Fourier transform. Next, the autocorrelations and cross-correlation of the input signals are computed for each frequency band and within a time period of interest in operation 106.

Next, in operation 108, the ambience extraction masks are computed. These are computed based on the cross-correlation and autocorrelations of the input signals and are further based on assumptions about the ambience levels in the respective left and right channels of the input signal. In one embodiment, equal levels of ambience in the channels are assumed. In another embodiment, equal ratios of ambience are assumed.

In operation 110, the ambience extraction masks are applied to the time-frequency representation of the input signal to generate time-frequency ambience component signals. In operation 112, time-domain output signals are generated from the time-frequency ambience components. In operation 114 the output signals are converted to the time domain by any suitable method known to those of skill in the relevant arts. Finally, an output signal is provided to the rendering or reproduction system in operation 116.

4. CORRELATION COMPUTATIONS

According to some embodiments of the present invention, methods are provided for compensating for a bias in the estimation of the short term cross-correlation. The time constant used in the recursive correlation computations has a considerable effect on the average estimated magnitude of the cross-correlation of the input signals. Using a small time constant in the correlation computation leads to underestimation of the amount of ambience. However, it is desirable to use a relatively small time constant to improve ambience extraction from dynamic signals. A compensation for the effect of a small time constant preserves the performance for dynamic signals while correcting the underestimation.

In a practical real-time implementation, the auto and cross-correlations can be approximated with recursive formulae as $$r_{LL}(t)=\lambda r_{LL}(t-1)+(1-\lambda)X_L^*(t)X_L(t)$$

$$r_{RR}(t)=\lambda r_{RR}(t-1)+(1-\lambda)X_R^*(t)X_R(t)$$

$$r_{LR}(t)=\lambda r_{LR}(t-1)+(1-\lambda)X_L^*(t)X_R(t) \tag{34}$$

where $\lambda\epsilon[0, 1]$ is the forgetting factor (See J. Allen, D. Berkeley, and J. Blauert, "Multi-microphone signal-processing technique to remove room reverberation from speech signals," *J. Acoust. Soc. Am.*, vol. 62, pp. 912-915, October 1977, and C. Avendano and J.-M. Jot, "Ambience extraction and synthesis from stereo signals for multi-channel audio upmix," in *Proc. IEEE Int. Conf. on Acoust., Speech, Signal Processing*, (Orlando, Fla., USA), May 2002, the contents of which are incorporated herein by reference in their entirety).

The time constant of the processing is determined by the forgetting factor and can be expressed as $$\tau = \frac{1}{f_c \ln(1-\lambda)} \tag{35}$$

where $f_c$ is the sampling rate used in the computation. Note that the sampling rate used in the computation is not necessarily equal to the sampling rate of the input signals. Specifically, in an STFT implementation $$f_c = \frac{f_s}{h},$$

where $f_s$ is the sampling rate of the original time-domain signals and h is the hop size used in the analysis.

For values of $\lambda$ near 1, the correlation estimates approach the true correlations of the past signals; note however that the computation in (34) is ill-defined for $\lambda=1$. For smaller $\lambda$, the recursive approximations correspond to computing the correlations of signals weighted with an exponentially decaying time window. Short time constants are necessary to correctly deal with transient signals; for stationary signals, however, limiting the computation time period results in estimation errors. In the following, these errors for the recursive estimation method are evaluated. Note, however, that the identified problems are not specific to the recursive estimation but are instead related to computing short-time estimates. Similar errors thus also occur for alternative cross-correlation estimation methods (e.g., see R. M. Aarts, R. Irwan, and A. J. E. M. Janssen, "Efficient tracking of the cross-correlation coefficient," *IEEE Trans. Speech Audio Proc.*, vol. 10, pp. 391-402, September 2002, the contents of which is incorporated herein by reference in its entirety).

For stationary input signals, the distributions of the correlation estimates depend on the forgetting factor such that the larger $\lambda$ is, the smaller the deviation of the estimate from the true value. This is illustrated for the cross-correlation coefficient $\phi_{LR}$ in the simulation results shown in FIG. 2. The cross-correlation coefficients were computed for two 240,000-sample equal-level Gaussian signals with a true cross-correlation of 0.5. The computations were performed in the STFT domain using 50% overlapping Hann-windowed time frames of length 1024; the depicted data is an aggregation over all of the resulting time-frequency tiles after the analysis had reached a steady state.

Figure 2:
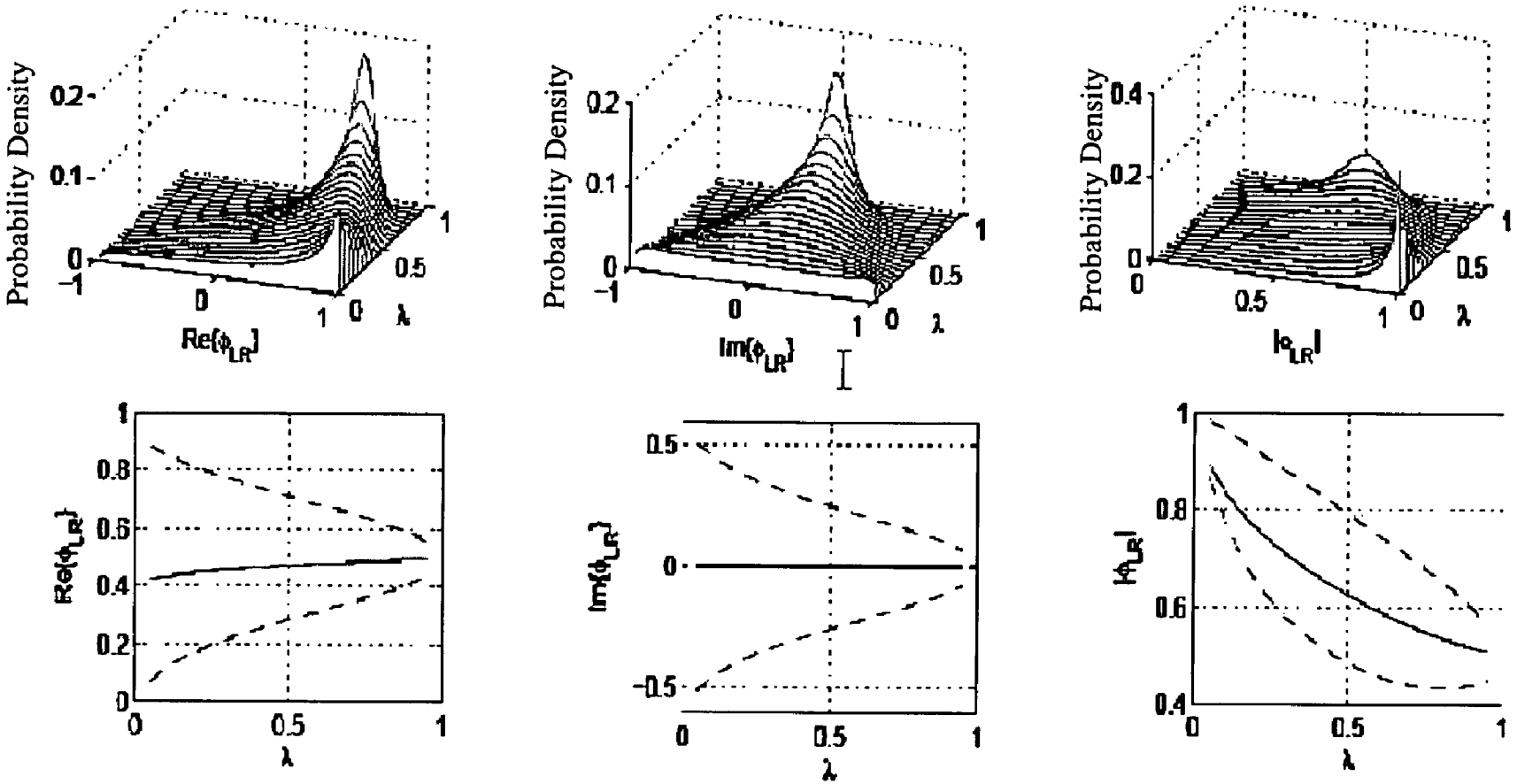
FIG. 2 illustrates the probability distribution functions of the real and imaginary parts and the magnitude of the estimated cross-correlation coefficients for a range of the forgetting factor $\lambda$.

The top panels in FIG. 2 show the probability distribution functions (PDF) of the real and imaginary parts and the magnitude of the estimated cross-correlation coefficients for a range of the forgetting factor $\lambda$. The bottom panels further illustrate the mean (solid line) as well as 25% and 75% quartiles (dashed lines) of the corresponding estimated values. The PDFs were estimated by forming histograms of the analyzed quantities over all time-frequency bins.

For the real and imaginary parts, the mean values are approximately correct regardless of $\lambda$. However, the magnitude of the cross-correlation coefficient $\phi_{LR}$ is, on average, considerably overestimated for small $\lambda$. This is due to the fact that the magnitude of the cross-correlation coefficient is a function of the magnitudes, not the signed values of the estimated real and imaginary parts.

Figure 3:
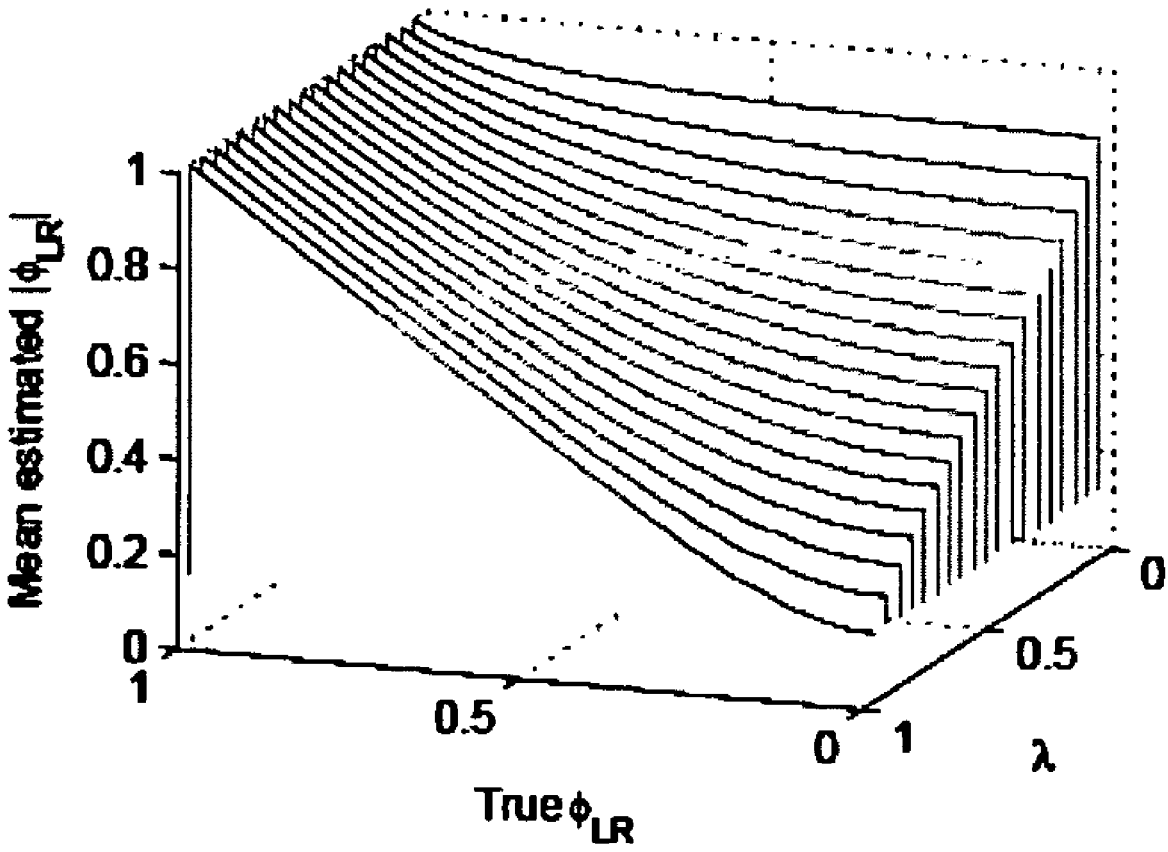
FIG. 3 illustrates the mean estimated correlation coefficient magnitude $|\phi_{LR}|$ as a function of true $|\phi_{LR}|$ for a range of $\lambda$.

Next, FIG. 3 further illustrates the mean estimated correlation coefficient magnitude $|\phi_{LR}|$ as a function of the true $|\phi_{LR}|$ for a range of $\lambda$. For small $\lambda$ the range of the means is considerably compressed. In the context of ambience extraction, this implies that the amount of ambience in the input signals will be underestimated. A compensation method to improve the correlation estimation is further discussed below.

Finally, it should be noted that estimation errors also occur for the computed autocorrelations (signal energies). These errors are typically small compared to those seen in the estimation of the magnitude of the cross-correlation coefficient. Nevertheless, uncorrelated signals will yield fluctuating short-time level difference estimates which may have an effect on the ambience extraction. Specifically, any method assuming that pure ambience has equal levels in the left and right channels will characterize such pure ambience as partly primary due to the estimation errors in the autocorrelations.

With a smaller forgetting factor, the ability to extract a correct amount of ambience deteriorates due to overestimation of the average cross-correlation between the input signals. Nevertheless, as measured with the cross-correlation criteria, the performance of the single-channel methods improves for smaller forgetting factors. As mentioned in Section 2.1, these methods essentially realize time-dependent filtering of the input signals. Their ability to separate the ambience and primary sound within the signals thus depends on being able to find time-frequency regions where one of these components dominates the other. Although using a small forgetting factor increases errors in the correlation estimation process, it is necessary in order to reliably find such time-frequency regions.

Since using a relatively small time constant appears advantageous for the single-channel ambience extraction methods, it is of interest to investigate whether the overestimation of the mean magnitude of the cross-correlation coefficient could be compensated in order to further improve the extraction results. FIG. 3 suggests that the range of the mean of the estimated cross-correlation coefficient is compressed to roughly $[1-\lambda, 1]$. Hence, as a very crude approximation, the short-time estimation of the cross-correlation coefficients could be improved by a compensation of the form $$|\hat{\phi}_{LR}| = \max\left\{0, 1 - \frac{1 - |\phi_{LR}|}{\lambda}\right\} \tag{44}$$

This compensation linearly expands correlation coefficients in the range of $[1-\lambda, 1]$ to $[0, 1]$. The function of the max{ } operator is to threshold the initial magnitude estimates that are originally below $1-\lambda$ to 0 in order to prevent the compensated magnitude from reaching negative values.

For the single-channel methods, the compensation increases the fraction of extracted ambient energy such that it becomes very close to correct values for small amounts of ambience. Furthermore, the capability of the equal-ratios method to extract correlated primary components is improved. However, the corresponding primary correlations for the equal-levels method are less improved. This can be explained by the sensitivity of the equal-levels method to estimation errors in the autocorrelations.

Although the two single-channel methods are theoretically identical when the true proportions of ambience in the left and right channels are the same, the equal-levels method underestimates the amount of ambience due to the random instantaneous level differences that occur between the uncorrelated ambience signals. As mentioned earlier, using a relatively short time constant is necessary in order to correctly deal with dynamic signals. In particular, being able to classify primary transients correctly is an important factor in separating signal components with subjectively primary and ambient nature.

Figure 4:
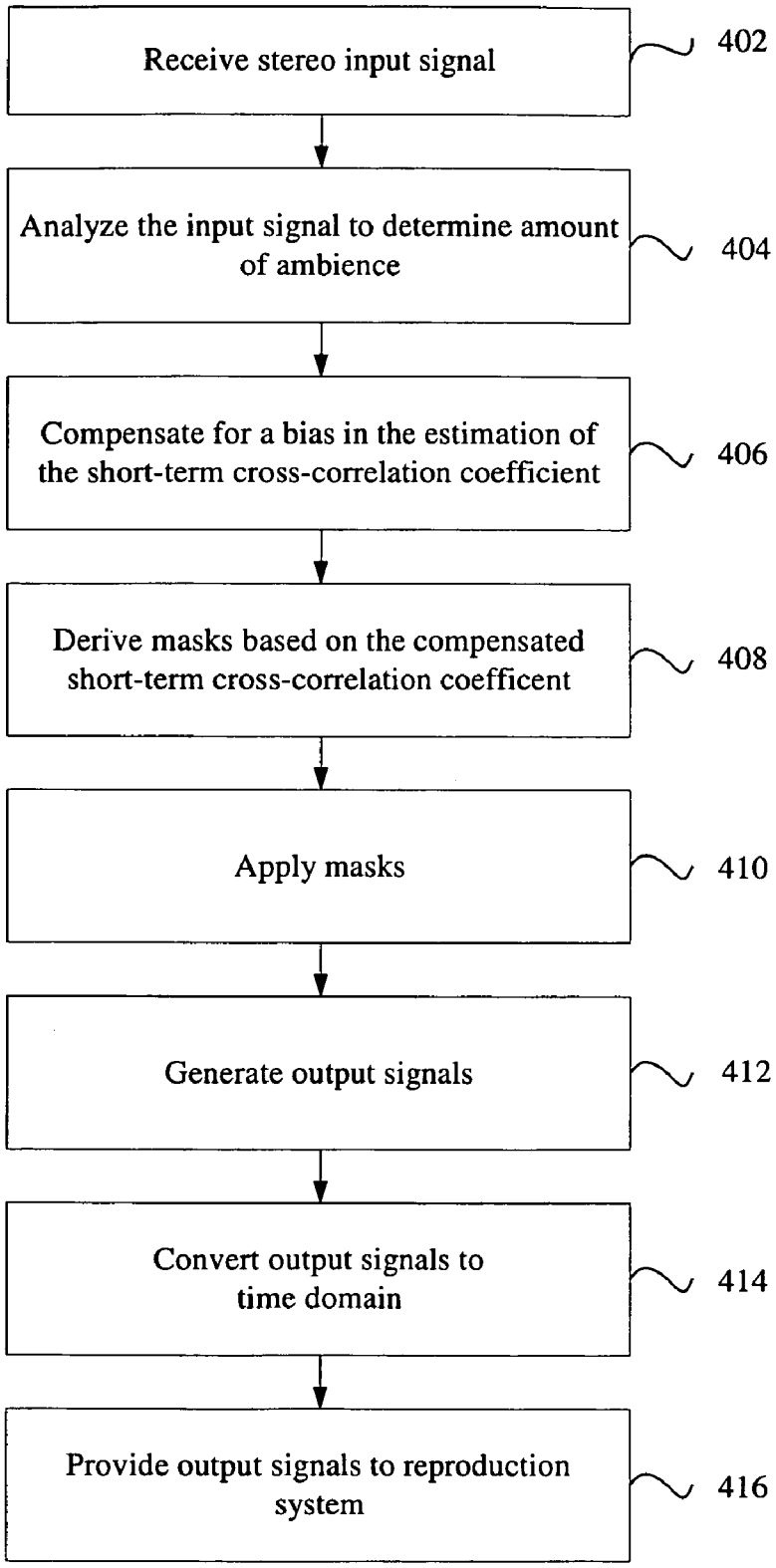
FIG. 4 is a flowchart illustrating a method of ambience extraction in accordance with one embodiment of the present invention.

To further elaborate, FIG. 4 depicts a flowchart illustrating a method of ambience extraction in accordance with one embodiment of the present invention. The method begins with the receipt of a stereo input signal in operation 402. Next, in operation 404, the input signal is analyzed to determine the amount of ambience in the stereo input signal. The input signal can be analyzed using any ambience estimation approach, e.g., single-channel approaches as discussed herein. According to various embodiments, the analysis of the input signal includes the estimation of a short-term cross-correlation coefficient. The analysis may also include having the input signals converted to a frequency-domain or subband representation using any known method, for example a short-time Fourier transform. Generally, the autocorrelations and cross-correlation of the input signals are performed for each frequency band and within a time period of interest.

In operation 406, any bias resulting from the estimation of the short-term cross-correlation coefficient can be compensated with a compensation factor (e.g., Eq. (44)). Next, in operation 408, the ambience extraction masks are derived. These are derived based on the compensated short-term cross-correlation coefficient (optionally compensated in some embodiments), cross-correlation and autocorrelations of the input signals and are further based on assumptions about the ambience levels in the respective channels of the input signal. In one embodiment, equal levels of ambience in the channels are assumed. In another embodiment, equal ratios of ambience are assumed.

In operation 410, the ambience extraction masks are applied to the time-frequency representation of the input signal to generate time-frequency ambience component signals. In operation 412, time-domain output signals are generated from the time-frequency ambience components. In operation 414 the output signals are converted to the time domain by any suitable method known to those of skill in the relevant arts. Finally, an output signal is provided to the rendering or reproduction system in operation 416.

Figure 5:
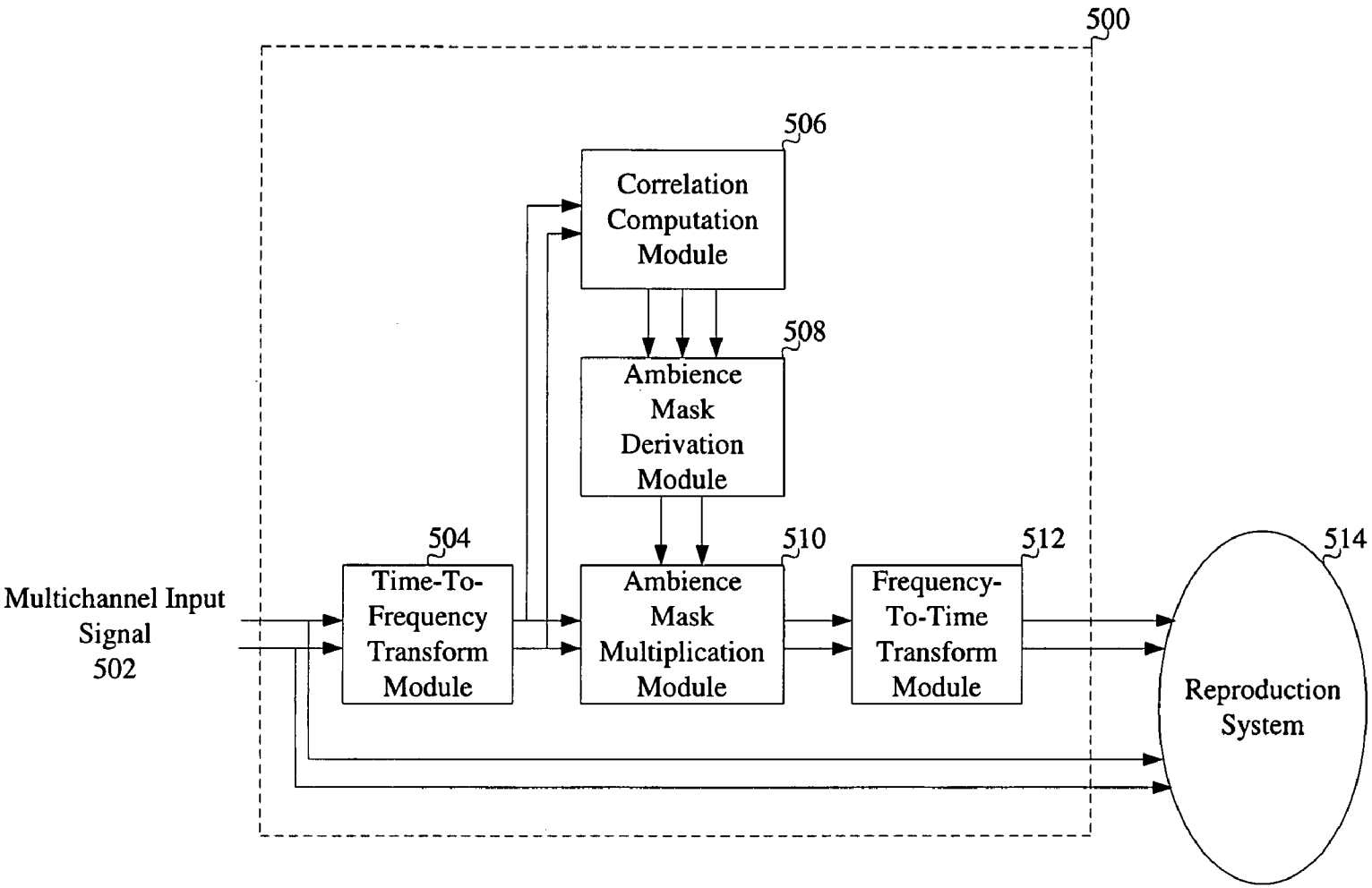
FIG. 5 illustrates a system for extracting ambience components from a multichannel input signal according to various embodiments of the present invention.

FIG. 5 illustrates a system 500 for extracting ambience components from a multichannel input signal 502 according to various embodiments of the present invention. System 500 includes a time-to-frequency transform module 504, a correlation computation module 506, an ambience mask derivation module 508, an ambience mask multiplication module 510, and a frequency-to-time transform module 512. It will be appreciated by those skilled in the art that system 500 can be configured to include some or all of these modules as well as be integrated with other systems, e.g., reproduction system 514, to produce an audio system for audio playback. It should be noted that various parts of system 500 can be implemented in computer software and/or hardware. For instance, modules 504, 506, 508, 510, 512 can be implemented as program subroutines that are programmed into a memory and executed by a processor of a computer system. Further, modules 504, 506, 508, 510, 512 can be implemented as separate modules or combined modules.

Referring to FIG. 5, multichannel input signal 502 is shown as channel inputs to a time-to-frequency transform module 504. In general, multichannel input signal 502 includes a plurality of channels. However, in order to facilitate understanding of the present invention, multichannel input signal 502 is shown in FIG. 5 as a stereo signal having a right channel and a left channel. Each channel can be decomposed into a primary component and an ambience component. Time-to-frequency transform module 504 is configured to convert multichannel input signal 502 into time-frequency representations for any number of channels of the multichannel input signal. Accordingly, the left and right channels are converted into time-frequency representations and outputted from module 504.

The outputs from module 504 become inputs to a correlation computation module 506. Correlation computation module 506 is configured to determine signal correlations of the outputs from module 504. For example, the signal correlations may include cross-correlation and autocorrelations for each time and frequency in the time-frequency representations. Correlation computation module 506 can also be configured as an option to estimate a short-term cross-correlation coefficient and/or to compensate for a bias in the estimation of the short-term cross-correlation coefficient by using the techniques of the present invention. As shown in FIG. 5, the autocorrelations and cross-correlation for the left and right channels are inputted into an ambience mask derivation module 508. Optionally, the cross-correlation line is configured to correspond to a compensated estimation of the short-term cross-correlation coefficient.

Ambience mask derivation module 508 is configured to derive the ambience extraction mask from the determined signal correlations, compensated short-term cross-correlation coefficient (optional), and/or an assumed relationship as to the ambience levels in the respective channels of the multichannel input signal. According to one embodiment, the assumed relationship is that equal ratios of ambience exist in the respective channels of the input signal. According to a preferred embodiment, the assumed relationship is that equal levels of ambience exist in the respective channels of the multichannel input signal.

Any number of ambience extraction masks can be derived. The derived ambience extraction mask can either be a common mask or separate masks for applying to multiple channels. According to one embodiment, a common mask is derived for applying to both the left and right channels. In a preferred embodiment, separate masks are derived for applying to the left and right channels respectively. Once the ambience extraction mask is derived, it is outputted to an ambience mask multiplication module 510. FIG. 5 shows two ambience extraction masks for the left and right channels outputted from module 508.

Ambience mask multiplication module 510 is configured to multiply an ambience extraction mask with the time-frequency representations to generate a time-frequency representation of the ambience component for respective channels of the multichannel input signal. As such, module 510 receives time-frequency representation inputs from module 504 and ambience extraction mask inputs from module 508 and outputs a corresponding time-frequency representation of the ambience components for the right and left channels.

The corresponding time-frequency representation of the ambience components are then inputted into a frequency-to-time transform module 512, which is configured to convert the ambience components into respective time representations. Frequency-to-time transform module 512 performs the inverse operation of time-to-frequency transform module 504. After the ambience components are converted, their respective time representations are outputted into a reproduction system 514. Referring to FIG. 5, reproduction system 514 also receives multichannel input signal 502 as inputs.

Reproduction system 514 may include any number of components for reproducing the processed audio from system 500. As will be appreciated by those skilled in the art, these components may include mixers, converters, amplifiers, speakers, etc. For instance, a mixer can be used to subtract the ambience components from multichannel input signal 502 (which includes the primary and ambience components for the right and left channels) in order to extract the primary components from multichannel input signal 502. To further enhance the listening experience, in some embodiments the ambience component is boosted in the reproduction system 514 prior to playback. According to various embodiments of the present invention, the primary and ambience components are then separately distributed for playback. For example, in a multichannel loudspeaker system, some ambience is sent to the surround channels; in a headphone system, the ambience may be virtualized differently than the primary components. In this way, the sense of immersion in the listening experience can be enhanced.

5. CONCLUSIONS

Several correlation-based ambience extraction methods were described. Two new single-channel ambience extraction masks were analytically derived based on the adopted signal model and different assumptions about the ambience levels: equal ratios and equal levels within the left and right input signals. It was described that the equal-levels assumption is preferable to the equal-ratios method.

It was also described that the time constant used in the recursive correlation computations has a considerable effect on the average estimated magnitude of the cross-correlation of the input signals. According to some methods, using a small time constant resulted in underestimation of the amount of ambience. Nevertheless, a relatively small time constant was favorable for a successful operation of the single-channel mask approaches. It was also described that a small time constant improves ambience extraction from dynamic input signals. A simple compensation for the effect of the time constant was presented to improve the ambience extraction results.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of ambience extraction from a multichannel input signal, the method comprising:

converting the multichannel input signal into a time-frequency representation;

determining signal correlations including the cross-correlation and autocorrelations for each time and frequency in the time-frequency representation; and applying an ambience extraction mask to the time-frequency representation, wherein the mask is based on the determined signal correlations and on an assumed relationship as to the ambience levels in the respective channels of the multichannel input signal.

2. The method as recited in claim 1, wherein the assumed relationship is that equal levels of ambience exist in the respective channels of the multichannel input signal.

3. The method as recited in claim 2, wherein the levels of ambience are measured in terms of energy levels in the respective channels of the multichannel input signal.

4. The method as recited in claim 1, wherein the assumed relationship is that equal ratios of ambience exist in the respective channels of the multichannel input signal.

5. The method as recited in claim 4, wherein equal ratios of ambience are measured in terms of ambience energy over input signal energy for each respective channel.

6. The method as recited in claim 1, wherein converting the multichannel input signal into the time-frequency representation results in separate time-frequency representations corresponding to each channel of the multichannel input signal.

7. The method as recited in claim 6, wherein applying the ambience extraction mask to the time-frequency representation comprises:

multiplying the ambience extraction mask and the corresponding time-frequency representations, the multiplication resulting in corresponding time-frequency representations of the ambience.

8. The method as recited in claim 6, further comprising:

deriving the ambience extraction mask from the determined signal correlations and the assumed relationship as to the ambience levels in the respective channels of the multichannel input signal.

9. The method as recited in claim 8, wherein deriving the ambience extraction mask results in a common ambience extraction mask for applying to the time-frequency representations of respective channels of the multichannel input signal.

10. The method as recited in claim 8, wherein deriving the ambience extraction mask results in different ambience extraction masks for applying to the time-frequency representations of the respective channels of the multichannel input signal.

11. A method of ambience extraction comprising:

analyzing an input signal to determine the amount of ambience in the input signal, wherein analyzing the input signal includes estimating a short-term cross-correlation coefficient; and compensating for a bias in the estimation of the short-term cross-correlation coefficient.

12. The method as recited in claim 11, wherein analyzing the input signal comprises:

converting the input signal into a time-frequency representation;

determining signal correlations including the cross-correlation and autocorrelations for each time and frequency in the time-frequency representation; and applying an ambience extraction mask to the time-frequency representation, wherein the mask is based on the determined signal correlations, compensated short-term cross-correlation coefficient, and on an assumed relationship as to the ambience levels in respective channels of the input signal.

13. The method as recited in claim 12, wherein the assumed relationship is that equal levels of ambience exist in the respective channels of the input signal.

14. The method as recited in claim 12, wherein the assumed relationship is that equal ratios of ambience exist in the respective channels of the input signal.

15. The method as recited in claim 12, wherein the ambience extraction mask includes a common ambience extraction mask for applying to the time-frequency representations of the respective channels of the input signal.

16. The method as recited in claim 12, wherein the ambience extraction mask includes different ambience extraction masks for applying to the time-frequency representations of the respective channels of the input signal.

17. A system for extracting ambience components from a multichannel input signal, the system comprising:

a time-to-frequency transform module operable to convert the multichannel input signal into a time-frequency representation for respective channels of the multichannel input signal;

a correlation computation module operable to determine signal correlations including the cross-correlation and autocorrelations for each time and frequency in the time-frequency representations;

an ambience mask derivation module operable to derive an ambience extraction mask from the determined signal correlations and an assumed relationship as to the ambience levels in the respective channels of the multichannel input signal;

an ambience mask multiplication module operable to multiply the ambience extraction mask with the time-frequency representations to generate a time-frequency representation of the ambience component for respective channels of the multichannel input signal; and a frequency-to-time transform module operable to convert the time-frequency representations of the ambience components into respective time representations.

18. The system as recited in claim 17, wherein the correlation computation module is further operable to estimate a short-term cross-correlation coefficient and to compensate for a bias in the estimation of the short-term cross-correlation coefficient.

19. The system as recited in claim 17, wherein the assumed relationship is that equal levels of ambience exist in the respective channels of the multichannel input signal.

20. The system as recited in claim 17, wherein the derived ambience extraction mask results in different ambience extraction masks for applying to the time-frequency representations of the respective channels of the multichannel input signal.

* * * * *